United States Patent [19]

Labbe

[11] Patent Number: 4,723,559

[45] Date of Patent: Feb. 9, 1988

[54] CONVEYING ROD-LIKE ARTICLES

[75] Inventor: Francis A. M. Labbe, Neuilly-sur-Seine, France

[73] Assignee: Molins PLC, Milton Keynes, England

[21] Appl. No.: 528,923

[22] Filed: Sep. 2, 1983

[30] Foreign Application Priority Data

Sep. 2, 1982 [GB] United Kingdom ..... 8224977

[51] Int. Cl.[4] ..... A24C 5/47

[52] U.S. Cl. ..... 131/94

[58] Field of Search ..... 131/94, 95

[56] References Cited

FOREIGN PATENT DOCUMENTS 0336306 3/1959 Switzerland ..... 131/94

*Primary Examiner*—V. Millin

*Attorney, Agent, or Firm*—John C. Smith, Jr.

[57] ABSTRACT

Apparatus for assembling and forming first and second articles of rod-like configuration into at least one composite rod includes a wheel (14) for alternately axially separating the first articles or tobacco sections (10) which are then transversely shifted in opposite directions by a wheel (16) onto two parallel moving conveyors on which the first articles or tobacco sections are spaced axially forming respective rod lines (11A, 11B). The second articles or filter portions (20) are conveyed towards the respective conveyors and introduced into the spaces between the first articles or tobacco sections on each rod line by means of a further wheel (18). The second articles or filter portions may be initially supplied as a single line and divided into two streams by staggering on the wheel (18). Some of the first articles or tobacco sections and second articles or filter portions on each rod line are moved axially relative to other first and second articles to assemble them into spaced groups by a timing wheel (28). A single continuous wrapper (104) may be longitudinally slit and then cut into wrapper sections. The wrapper sections are wrapped around the assembled first articles or tobacco sections and second articles or filter portions to unite the assembled first and second articles in each rod line.

30 Claims, 19 Drawing Figures

CONVEYING ROD-LIKE ARTICLES

This invention relates to a method of and apparatus for conveying rod-like articles, particularly for use in assembling and uniting aligned rod-like articles of the tobacco industry while the articles are moving in an endwise direction.

According to one aspect of the invention a method of conveying rod-like articles of the tobacco industry comprises advancing a stream of first articles in an endwise direction, diverting at least some of the articles in the stream so as to produce at least two streams of said first articles advancing in endwise directions along substantially parallel paths, introducing second articles into predetermined gaps in each of said two streams, assembling said first and second articles while conveying them along said paths, and forming at least one composite rod from each of said streams by uniting first and second articles in at least one wrapper. Preferably at least some of said first articles are diverted by a transverse shifting operation, although first articles may be otherwise caused to move along initially divergent paths leading to said paths.

The first articles may be tobacco sections produced from a continuous rod cigarette making machine. Where such articles are abutting they are preferably spaced slightly before diversion takes place. Diversion is preferably under control such that any transverse velocity reduces to zero when the shifted article has reached the position of its new axial path. Preferably the diverted article continues to be conveyed axially whilst it is diverted. Where there are only two eventual parallel paths successive first articles may be transversely shifted in opposite directions so that the parallel paths are equally spaced from the line of the original path of the first articles. In one preferred arrangement the parallel paths are parallel also to the initial stream of first articles.

The second articles, which may for example be filter portions, may be delivered as a single stream of such articles and subsequently conveyed along diverging paths which respectively lead towards and merge into the parallel paths for the first articles. Thus, for example, alternate second articles could be shifted transversely while still being conveyed axially so as to produce separate streams of second articles for merging with the streams of the first articles.

Feeding of the first and second articles on the parallel paths preferably includes assembly of the articles into predetermined groups and/or timing of predetermined articles so that the feed forward of the articles is synchronised with the feed of a wrapper to unite the articles and/or with a continuous rod cut-off. Where spaced predetermined groups of articles are assembled on each path a wrapper section may be delivered to each group so that it spans the junction or junctions of the group to unite the group into a composite rod. For example, a group may comprise two first articles and an interposed second article, the wrapper being positioned so that it covers the second article and overlaps the ends of the first articles. A continuous line of abutting articles may be produced on each path; preferably spaced wrapper sections are applied to span preselected junctions so that discrete groups of articles are still assembled into individual rods.

Preferably the wrapper for each of the paths is longitudinally slit from a wide web, so that a single wrapper bobbin can supply wrappers for each path.

According to another aspect of the invention apparatus for conveying rod-like articles of the tobacco industry means for advancing a stream of endwise moving first articles comprises means for diverting at least some of said articles to produce a plurality of streams of first articles moving in endwise directions on substantially parallel paths, means for conveying articles on said paths, means for introducing second articles into predetermined gaps in the streams on said paths, assembling means acting on articles in each stream to move at least some articles relative to other articles in the respective stream to control feed forward of the articles on the respective path and assemble the articles in a predetermined manner, and means for applying a wrapper to unite first and second articles assembled on each of said paths.

The diverting means may comprise means for transversely shifting predetermined first articles and be arranged to engage each first article and move it transversely onto a parallel path. In general there are preferably two such paths. Where the first articles are tobacco sections the paths may be about 30 mm apart and may be spaced equally from the line of a parallel original path of the tobacco sections. Preferably an accelerating wheel or other separating means is arranged upstream of the diverting means to create a small gap between abutting first articles before engagement by the diverting means. The diverting means may comprise a wheel rotatable about a substantially horizontial axis and provided with parallel grooves for receiving first articles, and being axially shiftable to move articles transversely while also conveying them in an endwise direction onto said paths. The first articles may be at least partially pneumatically supported while they are diverted.

The second articles (which may be filter portions) may be inserted in predetermined gaps in each stream on the parallel paths by means of an insertion device providing as many parallel paths as are required. Alternatively completely separate insertion devices and paths could be provided for the second articles. Where a common device is used the second articles may be received as a single stream and articles transversely displaced on the insertion device before being deposited between first articles on said parallel paths. One possible arrangement comprises an insertion device including a wheel cooperating with a guide surface around its periphery and being provided with suction to selectively retain second articles on its surface up to a release point after which centrifugal force urges an article outwards into engagement with a track on the guide surface which diverges from a straight path followed by an article still retained on the wheel. The articles on the guide track are still conveyed by the wheel (by means of radially projecting pushers, for example). By having different release points, controlled for example by a suction valve, several diverging paths for second articles can be produced. Transfer of articles from the repsective paths for second articles onto the parallel paths of the first articles may be controlled at a transfer position adjacent the parallel paths of the first articles; for example, second articles may be retained by suction at their respective transfer positions until the precise moment that the predetermined gap between first articles on the respective parallel path is adjacent the transfer positions, and may then be transferred pneumatically, e.g. by use of air jets. The air jets may include a component to accelerate the second articles to the speed of the first articles. Use of subsidiary timing means for the second articles in this way avoids the need for precise synchronisation of the feed conveyor for the second articles with that for the first articles on said parallel paths and allows operation of the conveyors at different speeds.

First and second rod-like articles on each of the parallel paths are preferably assembled into groups for further conveyance and uniting as spaced groups. Selected articles of each group are accelerated or decelerated relative to a conveyor for the articles on the path so that the precise position for further conveyance is determined. In a preferred arrangement, therefore, the assembling means comprises timing means and may typically consist of a wheel or worm having a cam surface or thread which engages the leading or trailing ends of the selected articles. Preferably the timing means includes at least two cam surfaces and is arranged such that a single common timing means can control articles on at least two parallel paths. In a preferred arrangement of this type the cams on a timing wheel are relatively displaced by 180° and each operates only on the articles on one of the parallel paths. With this arrangement it is important to ensure that the cam engaging articles on one path does not interfere with articles on the other path. In order to achieve this condition the positions of the first (and/or second) articles on one or more of the parallel paths relative to the positions of those articles on the other path or paths may be adjusted, preferably by retarding or accelerating those articles prior to engagement with the timing means. A suction band engaging the articles at one side and retarding the articles relative to a main conveyor band for one or more of the paths could be used for this purpose. A side band such as this may be provided, even where no adjustment of the relative positions of articles on the paths is required, to control the lateral positions of the articles, especially immediately after a transverse shifting or other diverting operation.

Preferably a single wrapper web is used to supply the wrapper for uniting the articles on at least two paths. Means may be provided for slitting the wrapper web into a plurality of wrappers of correct width for uniting the articles. Where spaced groups of articles are united on each of the paths the wrappers are subsequently cut into sections and spaced apart for correct application to each group. Discrete rods may be produced by similar application of spaced wrappers for each path. A continuous wrapper could be used to unite the articles on each path, and a cut-off device, synchronised with the assembling means, provided to sub-divide the continuous composite rod produced from the stream on each path.

Uniting is preferably carried out using a resilient pad as a backing for the wrapper or wrapper section to ensure a tight wrap around the articles, in accordance with the disclosure of copending U.S. patent application Ser. No. 508,399 filed June 27, 1983 by Labbe and assigned to the assignee of the present application, the disclosure of which is hereby incorporated herein in its entirety.

The invention will now be described, by way of example only, with reference to the accompanying diagrammatic drawings, in which.

Figure 1:
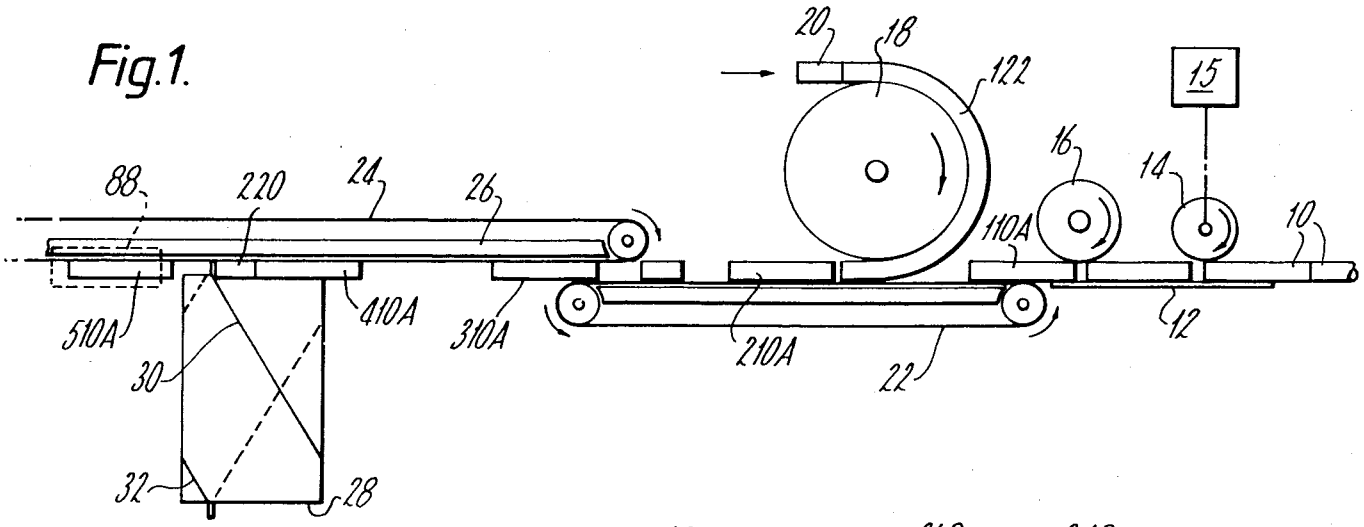
FIG. 1 is a side view of part of a machine for making filter cigarettes.
Figure 2:
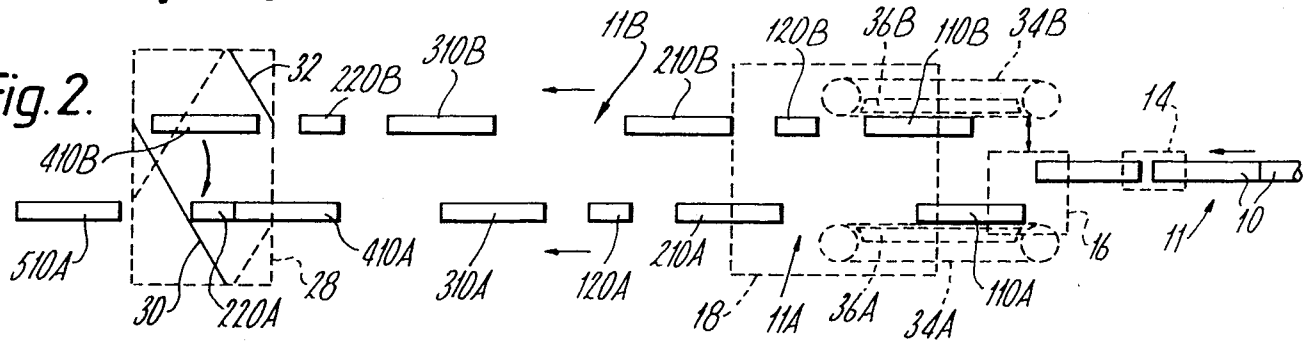
FIG. 2 is a plan view of the machine shown in FIG. 1.
Figure 3:
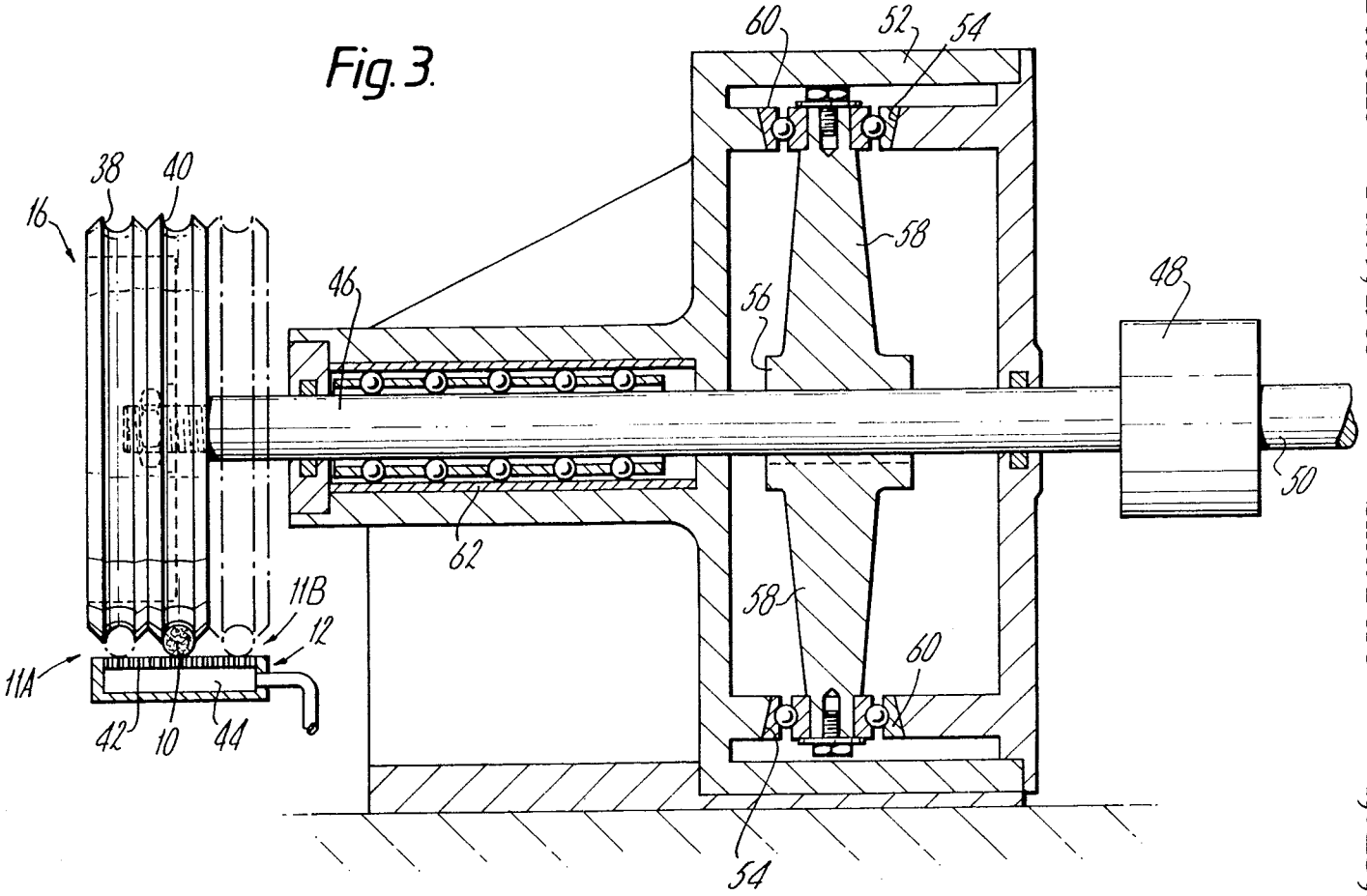
Figure 4:
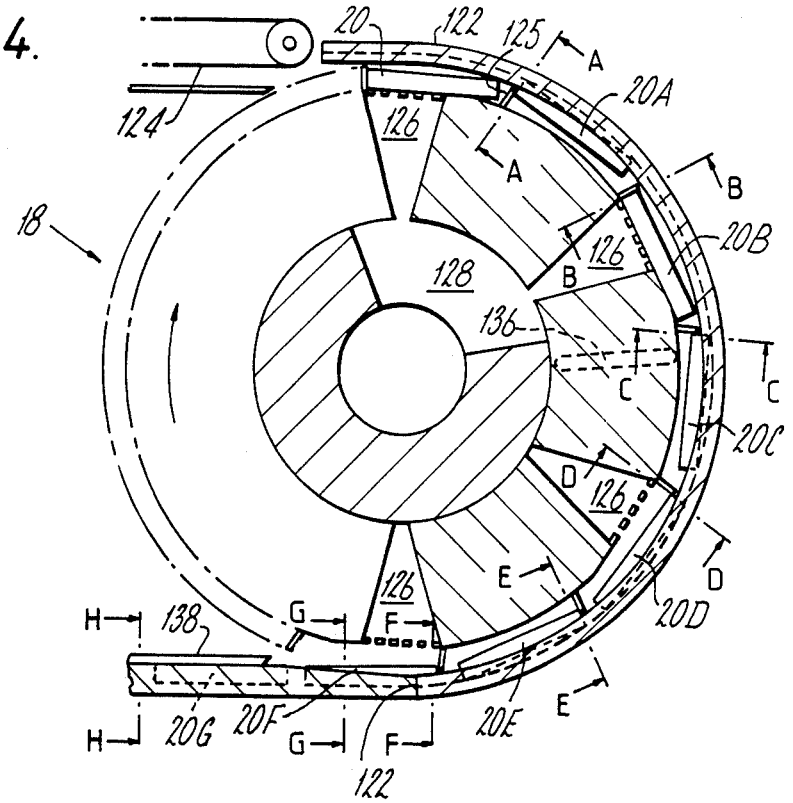
Figure 4A:
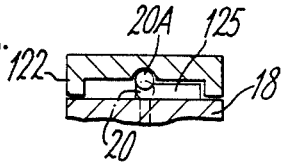
Figure 4B:
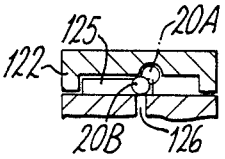
Figure 4C:
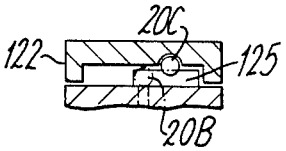
Figure 4D:
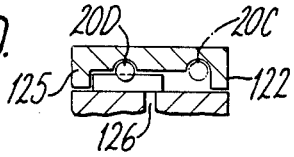
Figure 4E:
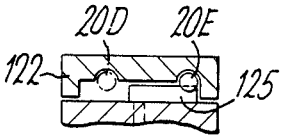
Figure 4F:
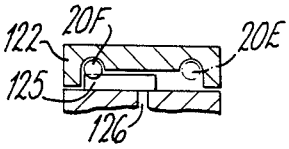
Figure 4G:
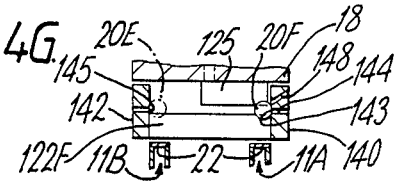
Figure 4H:
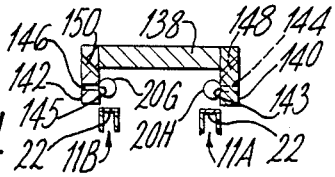
Figure 5:
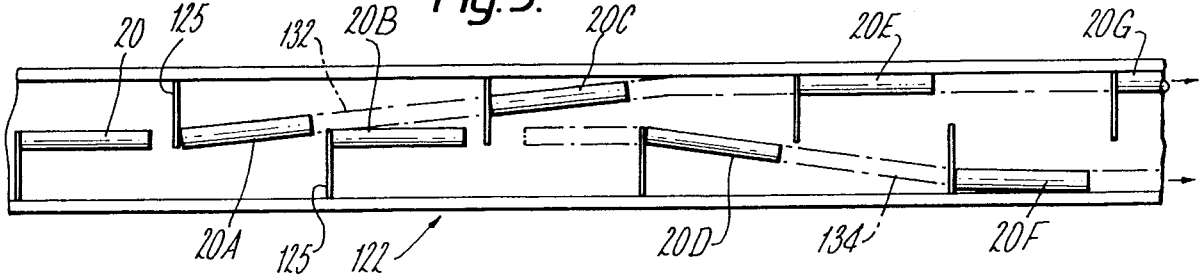
Figure 7:
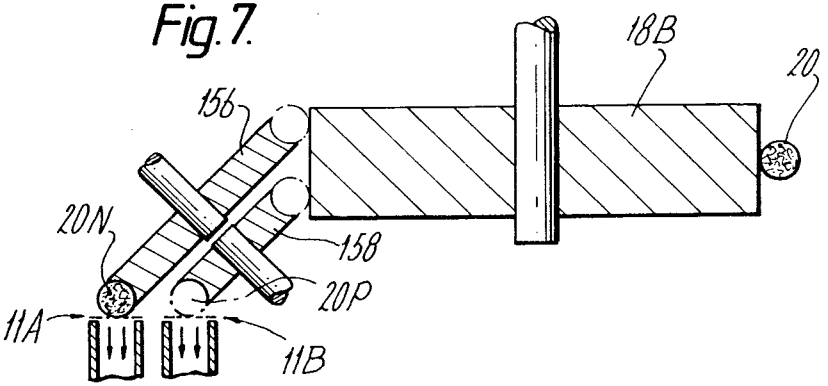
Figure 6:
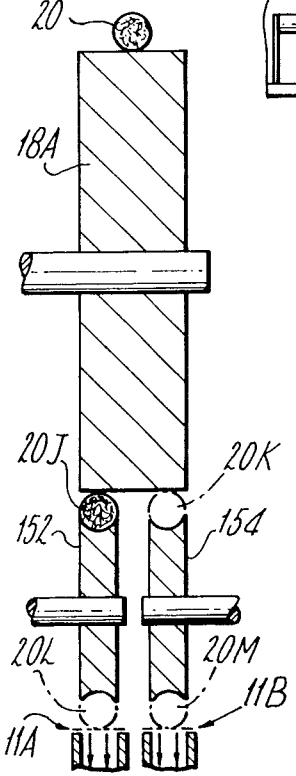
Figure 8:
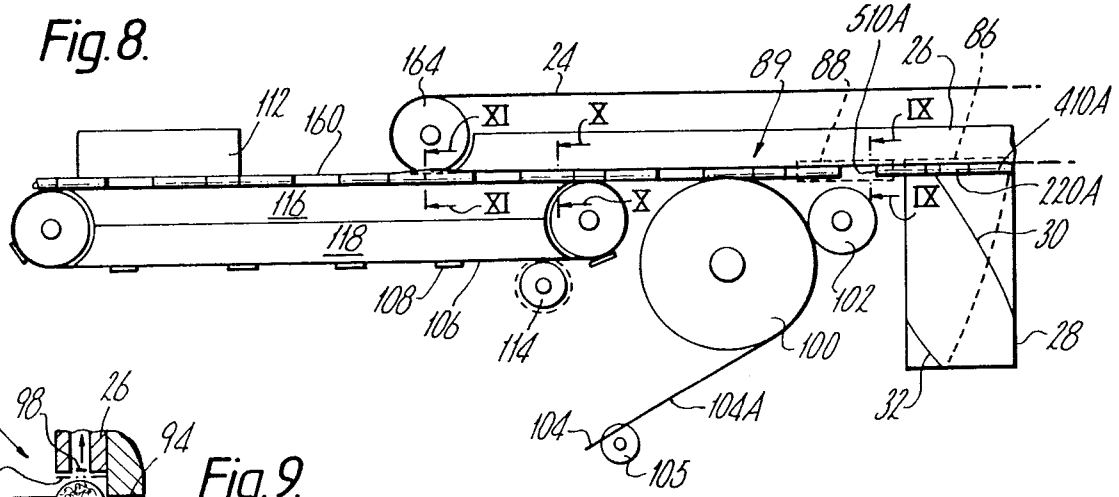
Figure 9:
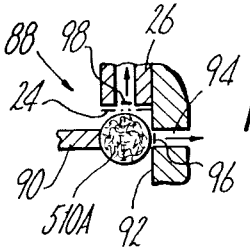
Figure 10:
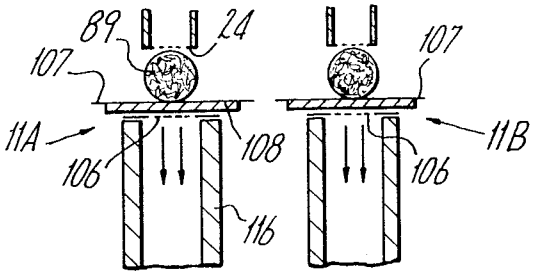
Figure 11:
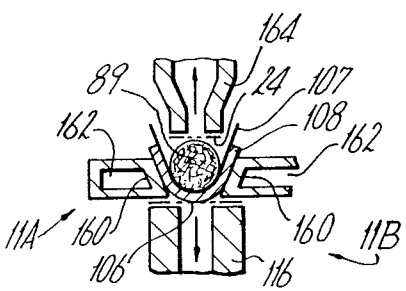

FIG. 3 is a part-sectional view of a shifting wheel assembly of the machine of FIGS. 1 and 2, FIG. 4 is a sectional view of a conveying wheel assembly of the machine of FIGS. 1 and 2, FIGS. 4A–4H are respectively radial sectional views on the lines A–H in FIG. 4, FIG. 5 is a projected view of the paths of the filter portions on the wheel of FIG. 4, FIG. 6 is a view of another conveying wheel assembly, FIG. 7 is a view of a further conveying wheel assembly, FIG. 8 is a side view of another part of the machine of FIGS. 1 and 2, FIG. 9 is a transverse sectional view on the line IX—IX of FIG. 8, FIG. 10 is a transverse sectional view on the line X—X of FIG. 8, and FIG. 11 is a transverse sectional view on the line XI—XI of FIG. 8.

Referring to FIGS. 1 and 2, abutting tobacco sections 10 are delivered on a guide plate 12 along a first rod line 11 from a continuous rod making machine. A rotary suction disc 14 having a drive means 15 for rotating the disc at a peripheral speed higher than that of the velocity of the tobacco sections 10 is arranged above the guide plate 12 and is effective to separate successive tobacco sections 10 by a few millimeters. Downstream of the disc 14 is a shifting wheel or disc 16 which is movable transversely to displace alternate tobacco sections 10 onto second parallel rod lines 11A and 11B. Thus, referring particularly to FIG. 2, the tobacco sections 110A, 210A, 310A, 410A and 510A have been shifted to the left onto the line 11A by the disc 16, and the tobacco sections 110B, 210B, 310B and 410B have been shifted to the right onto the line 11B. For the sake of clarity only the sections on the line 11A are shown in FIG. 1.

A stream of individual filter portions 20 is produced in any convenient manner and supplied to a filter portion staggering or conveying wheel or disc 18 which produces separate lines of filter portions for insertion on the rod lines 11A and 11B. The disc 18 is located downstream of the shifting disc 14 and above a pair of endless conveyor bands 22 (or possibly a single wide band 22) on which the respective tobacco sections on the lines 11A and 11B are conveyed from the end of the guide plate 12. The stream of filter portions 20 supplied to the disc 18 may be produced from a supply of filter portions in a hopper in a manner similar to that disclosed in British patent specification No. 971491. As will be explained below filter portions 120A, 220A and 120B, 220B are transferred from the filter portion conveying disc 18 respectively onto the lines 11A and 11B, so that on each line alternate gaps between tobacco sections receive a filter portion.

Downstream of the conveying disc 18 the tobacco sections 310A, 310B etc. and filter portions 220A, 220B etc. are respectively transferred from the bands (or band) 22 onto upper suction bands (or band) 24 which have a suction manifold 26. A timing wheel 28, carrying first and second projecting threads 30, 32, is arranged underneath the bands 24. The position and diameter of the wheel 28 is such that the threads 30 and 32 project into the rod lines 11A and 11B. The first thread 30 retards each filter portion 220A etc. on the rod line 11A and releases it at a precise position in time, so that its position during subsequent conveyance by the band 24 is accurately determined. The second thread 32 performs a similar function for the filter portions 220B etc. on the line 11B. A single timing wheel 28 is therefore effective to time the filter portions on each of the lines 11A and 11B. The operation of the timing wheel 28 is in other respects rather similar to that disclosed in British patent specification No. 971491 except that the threads 30, 32 are used to decelerate rather than accelerate the filter portions.

Each of the threads 30, 32 progresses about 180° around the wheel 28. Since the wheel 28 operates on both rod lines 11A and 11B it is important that the thread 30, which times the filter portions 220A on the line 11A, does not interfere with the articles on the line 11B and vice versa. In order to achieve a condition whereby such interference does not occur the tobacco sections 110B, 210B etc. on the line 11B are retarded between the shifting disc 16 and the conveying disc by means of a side band 34B which cooperates with a suction manifold 36B, as shown in FIG. 2. This ensures that the positions of the tobacco sections on the rod line 11B, relative to those on the rod line 11A, are such that interference can be avoided. For example, neither the thread 30 nor the thread 32 contacts the tobacco section 410B.

Particular combinations of tobacco section and filter portion length and spacing may permit operation of the timing wheel 28 without interference without any axial shifting of the articles in this manner. Where axial shifting is required the band 34B may extend or be located downstream of the position shown in FIG. 2, so that it may act on the filter portions as well as or instead of the tobacco sections. A similar band 34A and suction manifold 36A may be provided for the line 11A.

The shifting disc 16 is shown in more detail in FIG. 3 and includes circumferential circular grooves 38 and 40. In the position shown the tobacco section 10 is received on the guide plate 12 in the groove 40. The disc 16 is rotated at a peripheral speed which is approximately the same as that of the section 10 as this section is moved longitudinally the disc is moved axially (i.e. transverse to the rod line) into the position shown in dotted lines, so that the tobacco section 10 is moved into the rod line 11B. The groove 38 then occupies the position previously occupied by the groove 40 and the next tobacco section 10 is accordingly received in the groove 38. The disc 16 is subsequently axially returned to its original position so that this next tobacco section 10 in groove 38 is moved onto the rod line 11A. The disc 16 continues to be axially reciprocated at a rate such that alternate tobacco sections 10 are delivered to the respective rod lines 11A and 11B. The period of dwell with the groove 38 or 40 aligned with the rod line 11A or 11B respectively is sufficient to allow the tobacco section to be engaged by and conveyed clear of the groove by the respective band 22.

In order to aid shifting and prevent any deceleration of the tobacco sections during contact with the shifting disc 16 the guide plate 12 in the region of the disc comprises a porous plate 42 forming an upper surface of an air pressure manifold 44. The plate 42 allows an air flow which partially supports the tobacco section 10 and reduces any frictional drag. A suitable material for the plate 42 is a permeable high density polyethylene such as one of the VYON range of materials manufactured by Porvair Limited of Kings Lynn, Norfolk.

Axial and rotational movement of the disc 16 is derived from a shaft 46 connected by a sliding coupling 48 to a drive shaft 50 (itself connected to part of the main drive of the rod-making machine). The shaft 46 passes through a casing 52 housing an annular cam slot 54. A member 56 which is axially and rotationally fast on the shaft 46 includes opposed arms 58 each of which carries a cam follower 60 in engagement with the cam slot 54. The slot 54 is shaped so that the shaft 46 is reciprocated through one complete cycle twice during each revolution of the drive shaft 50. The casing 52 further includes a sliding bearing 62.

The shifting disc 16 and its drive arrangement are arranged so that each rod line 11A, 11B is spaced 15 mm from the line 11 of the incoming tobacco sections 10, i.e. so that the rod lines 11A, 11B are separated by 30 mm. Theorotically it would be possible to reduce this distance (which would make shifting the tobacco sections easier and would also be of advantage for filter portion insertion and timing) but this would have the disadvantage that it would then not be possible to place each article assembly centrally on its wrapper during the final stage of rod-making.

The spacing between the shifting disc 16 and the spacing disc 14 should be about one tobacco section length to maintain adequate control of the sections. Since the peripheral speed of the disc 16 is about the same as the speed of the tobacco sections its circumference is about the same as the length of four tobacco sections: its diameter is therefore typically about 90 mm. The diameter of the spacing disc 14 is about 45 mm. It would be possible to reduce the diameter of the shifting disc 16 to about 45 mm (so that its circumference is about equal to two tobacco section lengths). In this case, however, since only one reciprocation of the disc 16 would be required for each rotation of the shaft 46, there could be difficulty in balancing the cam mechanism. One factor in favour of reducing the size of the shifting disc 16, however, is that it would then be possible to increase the diameter of the spacing disc 14 (to 90 mm, say) which would provide additional contact with the tobacco sections 10 to ensure spacing by the required amount (2–5 mm).

Alternative arrangement for spacing and shifting the tobacco sections 10 are possible. In principle, two spiral spacer disc (e.g. as used currently on Molins rod-making machines to transfer rods into the catcher drum), each of which both accelerates and shifts to one side alternate tobacco sections so as to achieve the required spacing, could be used. Each disc, therefore, would move a tobacco section transversely by about 15 mm. Alternatively, a more elaborate single disc could be provided, rotatable about a horizontal axis and having a suction groove for engaging the tobacco sections, and also capable of oscillation (typically through 15° on each side of the rod line) about a vertical axis. The shape of the suction groove and the speed of rotation relative to the oscillation about the vertical axis would be such that the groove remains constantly parallel to itself and transfers the tobacco sections alternately to the left and right whilst also accelerating them to achieve the required spacing between them. The advantage of this arrangement (and also of the arrangement of FIG. 3) is that the transverse velocity reduce to zero as the tobacco section reaches the position of the rod line 11A or 11B. The side band 34A, 34B (which may be provided even if no axial shifting of the tobacco sections is required) help to control any slight residual transverse movement or bouncing and to locate each tobacco section on the respective conveyor 22.

FIGS. 4 and 5 show the conveying disc 18. The disc 18 is about 200 mm in diameter and is rotatable about a horizontal axis to define with a stationary guide 122 a 180° path for filter portions 20 delivered as a stream along the conveyor path 124. The stream of filter portions on the path 124 may, for example, be produced by an arrangement similar to that disclosed in British patent specification Nos. 876732 or 971491. The disc 18 has walls 125 which project approximately radially and are arranged to engage the rear faces of filter portions 20 and convey them between the disc 18 and the guide 122. The rear faces of the filter portions may be exposed for engagement by the walls 125 by slight transverse displacement of successive abutting filter portions (as in said specifications) or by feeding the stream around a curved path so that a V-shaped gap opens up between successive abutting portions. Alternate regions between successive projecting walls 125 are provided with suction slots 126 which cooperate with a stationary suction manifold 128 around which the disc 18 rotates. As shown particularly in FIGS. 4A to 4F and in FIG. 5 the stationary guide 122 is provided with first and second channels 132, 134, which have spaced start positions and which diverge from the centre line of the guide 122 in opposite directions.

Succesive filter portions 20 are engaged by a projecting wall 125 and are conveyed around the guide 122. Alternate filter portions 20, 20B are retained on the surface of the disc 18 by the suction slots 126 and remain on the path 135 in alignment with the path 124. The other alternate filter portions 20A, 20C, 20E are not retained on the disc 18 by suction and centrifugal force presses them against the guide 122 (where they are still engaged by the projecting wall 125). The filter portions 20A, 20C and 20E are guided by the channel 132 along a path which diverges from the straight path followed by the filter portions 20, 20B and 20D. During the arc of rotation of the disc 18 over which the filter portions 20A, 20C are initially shifted transversely in the channel 132 the filter portions 20 and 20B are retained by the suction acting through the slots 126 in a central position. Beyond the position of the filter portion 20C the suction manifold 128 terminates and suction applied through the slots 126 is vented through a slot 136, so that centrifugal force moves the filter portion 20D outwards into the path 134. Subsequently the filter portions are conveyed by the projecting walls 125 along the respective channels 132, 134 until, in the positions of the filter portions 20F and 20G, they are laterally spaced by the same amount as the rod lines 11A and 11B.

Referring particularly to FIGS. 4G and 4H (which are shown upright whereas FIG. 4F is relatively inverted) and also to Figure 4, the guide 122 terminates at 122F so that the filter portions 20F and 20G are directly above the respective rod lines 11A and 11B. Side guides 140, 142 extend beyond the end 122F of the guide 122 and include guide tracks 143, 145 to which suction is applied through passages 144, 146. The filter portions 20F and 20G are thus transferred onto the respective tracks 143, 145 and temporarily retained. Transfer onto the lines 11A, 11B is made substantially simultaneously for the filter portions 20F, 20G by passing timed pulses of high pressure air through angled passages 148, 150 which extend through the guides 140, 142. The passages 148, 150 are arranged so that as well as transferring the filter portions 20F, 20G downwards onto the respective rod line a substantial forward component of air velocity is attained, to accelerate the filter portions substantially to the speed of the tobacco sections on the lines 11A, 11B. The filter portions 20F, 20G are thus transferred onto the lines 11A, 11B in pairs axially spaced by about one filter portion length. The interval between transfer of each pair corresponds to the spacing required on the lines 11A, 11B, i.e., the spacing between the filter portions 120B and 220B in FIG. 2. As shown in FIGS. 4 and 4H a tongue 138 extends over the rod lines 11A, 11B downstream of the disc 18.

Alternative arrangements for transferring filter portions onto the rod lines 11A, 11B are shown in FIGS. 6 and 7. In FIG. 6 filter portions 20 are passed around a disc 18A which is similar to the disc 18 except that it is spaced vertically above the rod lines 11A and 11B. Filter portions 20J, 20K which have been laterally spaced by the disc 18A are transferred to independently rotatable suction or pusher discs 152, 154 which transfer the portions into the positions of filter portions 20L, 20M on the rod lines 11A, 11B. The arrangement shown in FIG. 7 is similar except that the disc 18B is rotatable about a vertical axis and the transfer discs 156, 158, which deposit the filter portions 20N, 20P on the rod lines 11A, 11B, are of different sizes and are rotatable about inclined axes. The discs 152, 154 and 156, 158 rotate at a peripheral speed equal to that of the assembly conveyors 22. If their diameters are approximately half those of the conveying discs 18A, 18B, the rotational speed of the discs 152, 154 and 156, 158 is approximately six times that of the discs 18A, 18B. Accordingly, if there are six pairs of filter portions on each of the discs 18A, 18B, (i.e. similar to the disc 18) then only one pair of filter portions is conveyed by the discs 152, 154 and 156, 158 at any one time.

Instead of using a conveying disc similar to the discs 18, 18A, and 18B the filter portions might be laterally transferred to provide spaced parallel paths by transversely blowing alternate or successive filter portions. Alternatively, filter portions might be staggered while moving transverse to their lengths on a fluted drum (as on Molins PA8 and PA9 machines) and a linear conveyor for each line used to strip the filter portions out of the flutes of the drum.

Assembly and uniting of the groups of tobacco sections and filter portions is shown in FIGS. 8 to 11. FIG. 8 shows a downstream part of the machine of FIG. 1. The tobacco sections and filter portions on the rod lines 11A and 11B are separately assembled and wrapped; the lines are substantially identical and include some common features, e.g. drives and suction supply. Only the line 11A is shown in FIG. 8.

The timing wheel 28 retards the filter portion 220A and the following tobacco section 410A moves into abutment with it. Suction applied in the region 86 of the manifold 26 may be reduced to allow the portion 220A and section 410A to be retarded by the thread 30. Downstream of the wheel 28 a braking device 88, shown more clearly in FIG. 9, causes a leading tobacco section 510A to be retarded so that the filter portion 220A and trailing tobacco section 410A move together into abutment with the leading tobacco section to create a group 89 comprising leading and trailing tobacco sections and an interposed filter portion. The device 88 comprises two cams 90 spaced along the line 11A and each rotatable about a substantially vertical axis and acting together to displace each leading tobacco section 510A by a small amount in a lateral direction. Two spaced cams 90 are used so that the section 510A remains parallel to itself while it is displaced. The lateral displacement is sufficient to reduce the suction attraction of the manifold 26 through the conveyor 24 and, further, the side of the leading tobacco section remote from the cams 90 comes into contact with a stationary guide surface 92 which includes a suction manifold 94. The effect of this is that the section 510A is retarded relative to the conveyor 24 by frictional engagement with the guide surface 92 and manifold 94. The suction manifold 94 includes a restrictor 96; similarly, the manifold 26 includes a restrictor 98, at least in the region of the device 88. These restrictors 96, 98 restrict the flow of air into the respective manifolds 94, 26 when leakage occurs so that the suction effect on a tobacco section or filter portion is greatly reduced if it does not seal the respective manifold. The cams 90 may be belt driven from the drive to the filter portion conveying disc 18.

Each leading tobacco section 510A is retarded by the guide surface 92 and the manifold 94 until the filter portion 220A and the trailing tobacco section 410A contact it. The suction force retaining these on the conveyor 24 is higher than the braking force on the leading tobacco section, so that the abutted assembly is subsequently conveyed as a group 89 by the suction conveyor 24. The surface 92 is shaped to guide the leading tobacco section 510A back to the centre line of the conveyor 24 and into alignment with the other members of the group 89. The timing of each group 89 is set by the release point of the thread 30 on the leading end of the filter portion 220A and is not lost by contact with the leading tobacco section 510A.

Downstream of the braking device 88 the spaced groups pass to a cork patch applicator drum 100, having a cork cutting drum 102, at which a cork patch cut from a cork web 104A, is applied over the filter portion and adjacent ends of the tobacco sections of the group 89. The cork applicator drum 100 is of sufficient width to supply cork webs for cutting into patches to both rod lines 11A and 11B. A cork web 104 may be longitudinally slit into webs 104A and 104B by a slitting knife 105. The cork cutting drum 102 may extend across the full width of the cork applicator drum 100 and have laterally and circumferentially spaced knives for independently cutting the cork webs 104A and 104B. The cork web 104 may be longitudinally slit and laterally spaced in accordance with the disclosure of British patent specification Nos. 1019092 or 1576212.

The group 89, still carried by the suction conveyor 24, is transferred onto a suction tape 106 which passes over upper and lower suction manifolds 116, 118 and carries flexible compressible pads 108 spaced at intervals corresponding to the position of cork patches 107 applied over the groups 89. As indicated in FIG. 10 the pads 108 are retained on the conveyor 106 by suction and are flat when they initially contact the cork patch 107 carried by the group 89. Subsequently, as shown in FIG. 11, the sides of the pads 108 are engaged by side guides 160 which progressively bend the pad, and hence the cork patches 107, around the adjacent group 89. The guides 160 form sides of pressure air manifolds 162 so that running friction of the pads 108, which are still engaged by the tape 106 to which suction is applied from the manifold 116, is kept to a minimum. Downstream of the end pulley 164 of the conveyor 24 the pads 108 and cork patches 107 are further wrapped around the assemblies 89 and a conventional lap seal produced by means of a heater 112 (or heater and cooler 112).

The pads 108 ensure a tight wrap of the cork patches 107 around the filter portions and the ends of the tobacco sections of the groups 89, the resilience of the pads pressing on the cork patches. It is contemplated that the same pads 108 would be useful for a wide variety of tobacco section and filter portion diameters and for a variety of the filter portion lengths. Typically the pad width might be about 80% of the filter portion circumference, and have a length not less than that of the cork patch. The pads 108 may have a composite structure comprising longitudinal (i.e. parallel to the filter portion axis) threads embedded in a moulded flexible carrier material. The threads may be of nylon, polyamide or a similar substance and the carrier may be of silicon rubber. A woven structure having a majority of longitudinal threads could be used. The pads should be flexible for wrapping around the cork patches and enclosed groups but have some rigidity in the longitudinal direction for conveyance and timing.

The pads 108 remain on the conveyor 106 and are conveyed along its lower run by means of suction manifold 118. The timing of the pads 108 on the conveyor 106, i.e. the control of the position of each pad so that it arrives on the upper run of the conveyor in a position exactly corresponding to that of a cork patch 107, is maintained by a timing wheel 114 carrying an abutment which may advance (or retard) each pad slightly relative to the conveyor 106. The spacing of the pads 108 on the conveyor 106 is determined by the spacing of the filter portions of the groups 89. As this can remain unchanged for a wide range of lengths of filter portions and tobacco sections, change of path length of the conveyor 106 to adjust the spacing of the pads (other than for small timing changes made by the wheel 114) is not required. Furthermore, the speeds of the conveyors 24 and 106 can remain the same for different types of group 89.

Since individual groups 89 are united in the garniture no continuous rod cut-off is required and the assembled groups 89 pass directly to a catcher drum or the like.

The suction conveyor 106 carrying the pads 108 cooperates with suction manifolds 116, 118; each of these manifolds may be provided with restrictors (similar to the restictors 96, 98) to reduce the air flow, and hence the loss of suction in the manifolds, where the pads 108 are not present.

As indicated in FIGS. 10 and 11 substantially identical parallel assemblies are provided for the rod lines 11A and 11B.

I claim:

1. A method of assembling and forming first and second articles of rod-like configuration into at least one composite rod, comprising advancing a stream of first articles in an endwise direction, diverting at least some of the articles in the stream so as to produce at least two streams of said first articles advancing in endwise directions along substantially parallel paths with predetermined gaps between at least some adjacent articles in each of said streams, introducing second articles into said predetermined gaps in each of said at least two streams, assembling said first and second articles while conveying them along said paths, and forming at least one composite rod from each of said streams by uniting first and second articles in at least one wrapper.

2. A method as claimed in claim 1, wherein at least some of said first articles are diverted by a transverse shifting operation.

3. A method as claimed in claim 2, wherein successive first articles are transversely shifted in opposite directions.

4. A method as claimed in claim 1, wherein said second articles are delivered as a stream of endwise moving articles, at least some of which are diverted so as to produce a plurality of endwise moving streams for introduction into the streams of first articles on said paths.

5. A method as claimed in claim 1, wherein the second articles are introduced between said first articles on said paths by merging a plurality of streams of second articles with said streams of first articles on said paths.

6. A method as claimed in claim 1, wherein the first and second articles are assembled by advancing or retarding selected articles on said paths, and a wrapper is applied to each of said streams on its respective path.

7. A method as claimed in claim 6, wherein wrappers for each of the streams on said paths are obtained by longitudinally slitting a wide wrapper.

8. A method as claimed in claim 1, wherein the articles are assembled on said paths into discrete groups of predetermined composition and individual wrappers are applied to each group, including synchronising assembling and wrapping of each group.

9. A method as claimed in claim 1, wherein a continuous composite rod is produced from the streams on each of said paths, including synchronising a cutting operation for subdividing the continuous rod at predetermined positions with the assembling and wrapping of said rod.

10. Apparatus for assembling and forming first and second articles of rod-like configuration into at least one composite rod, comprising means for advancing a stream of endwise moving first articles, means for diverting at least some of said articles to produce a plurality of streams of first articles moving in endwise directions on substantially parallel paths with predetermined gaps between at least some adjacent articles in each of said streams, means for conveying articles on said paths, means for introducing second articles into said predetermined gaps in the streams on said path, assembling means acting on articles in each stream to move at least some articles relative to other articles in the respective stream, to control forward feed of the articles on the respective path and assemble the articles in a predetermined manner, and means for applying a wrapper to unite first and second articles assembled on each of said paths.

11. Apparatus as claimed in claim 10, wherein the diverting means comprises means for transversely shifting predetermined first articles.

12. Apparatus as claimed in claim 11, wherein the transverse shifting means is arranged to engage each first article in said stream.

13. Apparatus as claimed in claim 11, wherein the transverse shifting means comprises a conveyor and means for moving said conveyor in a direction to convey articles in said endwise direction of said stream and to convey articles in a direction transverse to said endwise direction.

14. Apparatus as claimed in claim 13, wherein said moving means is arranged to reciprocate said conveyor in said transverse direction.

15. Apparatus as claimed in claim 11, wherein the transverse shifting means comprises a wheel provided with a plurality of parallel grooves for receiving first articles.

16. Apparatus as claimed in claim 10, including means for separating successive first articles of the stream upstream of the diverting means.

17. Apparatus as claimed in claim 10, including means for at least partially pneumaticially supporting first articles during operation of said diverting means.

18. Apparatus as claimed in claim 10, wherein the means for introducing second articles comprises means for feeding second articles to each of said paths from a common source.

19. Apparatus as claimed in claim 18, including means for feeding an endwise moving stream of second articles from said source and means for diverting articles from said stream to create a plurality of streams of endwise moving second articles.

20. Apparatus as claimed in claim 19, wherein the means for diverting the second articles includes a suction conveyor and guide means defining a plurality of paths for articles conveyed by said suction conveyor.

21. Apparatus as claimed in claim 20, including suction valve means for controlling passage of second articles relative to said guide means so that articles are passed to predetermined paths defined by said guide means.

22. Apparatus as claimed in claim 10, wherein the means for introducing second articles onto said paths includes pneumatic conveying means.

23. Apparatus as claimed in claim 10, wherein said assembling means includes common timing means for assembling first and second articles on said paths.

24. Apparatus as claimed in claim 23, wherein the timing means includes a timing conveyor carrying article engaging abutments for accelerating or decelerating pre-selected articles of the streams on said paths relative to said conveying means.

25. Apparatus as claimed in claim 23, wherein the timing means is arranged to assemble discrete groups of articles on each of said paths.

26. Apparatus as claimed in claim 10, including means for advancing or retarding articles of at least one stream on said paths to produce a desired positional relationship between articles on one path and articles on another path.

27. Apparatus as claimed in claim 26, wherein said advancing or retarding means comprises a suction conveyor arranged to engage articles on said paths while conveyed by said conveying means.

28. Apparatus as claimed in claim 10, including means for feeding a wrapper web, means for longitudinally slitting the wrapper web to produce wrappers for each of said streams on said paths, and means for feeding said wrappers to unite articles on said paths.

29. Apparatus as claimed in claim 10, including means for applying separate wrappers to predetermined spaced junctions between first and second articles on said paths.

30. A cigarette making machine including apparatus as claimed in claim 10, wherein said first articles are tobacco sections and said second articles are filter portions.

* * * * *